United States Patent [19]

Carlson

[11] 4,043,703

[45] Aug. 23, 1977

[54] IMPACT RESISTANT COMPOSITE ARTICLE COMPRISING LAMINATED LAYERS OF COLLIMATED FILAMENTS IN A MATRIX WHEREIN LAYER-LAYER BOND STRENGTH IS GREATER THAN COLLIMATED FILAMENT-MATRIX BOND STRENGTH

[75] Inventor: Robert G. Carlson, Greenhills, Ohio

[73] Assignee: General Electric Company, Cincinnati, Ohio

[21] Appl. No.: 643,496

[22] Filed: Dec. 22, 1975

[51] Int. Cl.[2] ..... B23P 15/04; B32B 7/04; B32B 31/20; F01D 5/14

[52] U.S. Cl. ..... 416/230; 29/156.8 B; 156/179; 156/306; 428/114; 428/294; 428/577; 428/608; 428/623; 428/636

[58] Field of Search ..... 29/156.8 B, 191.6, 197.5, 29/195, 199; 416/230; 428/114, 294, 577, 608, 623, 636; 156/179, 306

[56] References Cited

U.S. PATENT DOCUMENTS

| | | | |
|---|---|---|---|
| 3,600,103 | 8/1971 | Gray | 416/230 |
| 3,606,667 | 9/1971 | Kreider | 416/230 |
| 3,615,277 | 10/1971 | Kreider et al. | 428/114 |
| 3,649,425 | 3/1972 | Alexander | 416/230 |
| 3,679,324 | 7/1972 | Stargardter | 416/230 |
| 3,719,538 | 3/1973 | Carlson et al. | 156/179 |
| 3,900,150 | 8/1975 | Delgrosso | 29/191.6 |
| 3,915,781 | 10/1975 | Novak | 428/114 |
| 3,942,231 | 3/1976 | Whitaker | 29/156.8 B |
| 3,979,244 | 9/1976 | Novak | 29/156.8 B |
| 4,000,956 | 1/1977 | Carlson et al. | 416/230 |

*Primary Examiner*—J.C. Cannon

*Attorney, Agent, or Firm*—Robert C. Lampe, Jr.; Derek P. Lawrence

[57] ABSTRACT

A method of making a composite article having at least a minimum selected impact strength by first obtaining the impact energy absorption/shear strength relationship for the collimated filaments and matrix material comprising the article. Impact strength is improved by the selection of the relative bond strengths between constituents and the orientation of selected matrix materials relative to the impact surface of the article.

9 Claims, 4 Drawing Figures

IMPACT RESISTANT COMPOSITE ARTICLE COMPRISING LAMINATED LAYERS OF COLLIMATED FILAMENTS IN A MATRIX WHEREIN LAYER-LAYER BOND STRENGTH IS GREATER THAN COLLIMATED FILAMENT-MATRIX BOND STRENGTH

BACKGROUND OF THE INVENTION

This invention relates to composite materials for use in blades of fluid flow machines and the like and, more particularly, to increasing the impact tolerance of such materials.

For many years attempts have been made to replace the relatively heavy, homogeneous metal blades and vanes of fluid flow machines such as gas turbine engine compressors with lighter composite materials. The primary effort in this direction has been toward the use of high strength, elongated filaments composited in a lightweight matrix. Early work involved glass fibers, and more recent efforts have been directed toward the utilization of boron, graphite and other synthetic filaments. These later materials have extremely high strength characteristics as well as high moduli of elasticity which contributes to the necessary stiffness of the compressor blades and vanes.

Many problems have confronted the efforts to utilize these filaments, particularly in adapting their unidirectional strength characteristics to a multidirectional stress field. To a large extent, these problems have been overcome and composite blades have been demonstrated with performance characteristics, in many areas, equal to or better than their homogeneous metal counterparts in addition to providing the expected and significant weight reductions.

However, one major obstacle to the realization of the full potential of composite materials for gas turbine engine applications has been their relatively low tolerance to impact damage or foreign object damage (FOD) due to foreign object ingestion. Typically, a composite blade is fabricated by bonding together a plurality of substantially parallel filament laminates. Each laminate consists of a single layer of generally elongated filaments anchored in a lightweight matrix. Where, for example, the matrix comprises aluminum and the filaments are boron, aluminum foil sheets are placed on both sides of the boron filament layer and bonded together by the known diffusion bonding or continuous-roll bonding technique.

Under certain processing conditions in composite blade manufacturing, the degree of bonding can be extensive, resulting in a rigid structure incapable of tolerating high impact loadings. Since the matrix material cannot absorb much energy through deformation, and since the laminates are extensively bonded, substantially all of the load is carried by the filaments which are relatively hard and brittle. Fracture of the filaments generally results in fracture of the blade. Higher impact strength matrix materials, on the other hand, do not possess the bondability of the more ductile materials. If bonding is substantially incomplete between filament laminates, the laminates tend to slide with respect to each other under shear loadings, much in the manner of a deck of cards. When such sliding occurs, ability to absorb impact energy greatly decreases. Increases in bonding pressure and temperature, though effective in increasing bonding, can produce crushing of the filaments and high residual thermal stresses due to the different coefficients of expansion of the various constituents. Both of these factors contribute to reduced impact resistance and, thus, reduced tolerance to foreign object impact damage.

Thus, it becomes desirable to develop a composite material which is adaptable to the environment of a gas turbine engine rotor blade by exhibiting improved tolerance to foreign object impact. Such a material should exhibit the tolerance to impact of known higher-impact strength materials and yet possess the bondability of high fatigue strength materials.

SUMMARY OF THE INVENTION

Accordingly, it is a primary object of the present invention to provide an improved method of making a filament composite article having at least a minimum required impact strength.

It is a further object of the present invention to provide a filament composite article having optimum shear strength under impact loading for the materials selected for fabrication of the article.

It is yet another object of the present invention to provide a gas turbine engine rotor blade having improved tolerance to foreign object impact.

These and other objects and advantages will be more clearly understood from the following detailed description, the drawings and specific examples, all of which are intended to be typical of, rather than in any way limiting to the scope of, the present invention.

Briefly stated, the above objectives are accomplished in an article such as a blade formed of elongated, small-diameter filaments, having high strength and high modulus of elasticity, which are composited into a lightweight matrix. A plurality of such filament laminates are bonded together in a substantially parallel relationship to form the primary composite structure of the blade.

In order to insure at least a minimum selected impact strength, specimens of the bonded filament laminates of the same materials as to be used in the fabricated article are prepared, each specimen having a varying degree of shear strength. (Shear strength, in turn, being dependent upon the degree of bonding). The impact energy absorption/shear strength data relationship for the specimens can be obtained by known methods such as Charpy impact testing. It has been discovered that, as the degree of bonding increases, there is a corresponding increase in impact energy absorption followed by a reduction of impact energy absorption. By determining the degree of bonding which optimizes the impact tolerance for such materials, the article may then be fabricated with confidence in obtaining the maximum impact energy absorption capability.

It has also been determined that in such an optimized article, the relative bond strengths between constituent elements is determinative of the overall impact strength. In particular, it is desirable in any article subject to impact loading that the energy absorption mechanism includes debonding of the filaments from the matrix material prior to interlaminate delamination, and that the ultimate failure is tensile fracture of all the individual filaments.

In the preferred embodiment of a metallic composite article, monotape laminates comprising a single layer of boron filaments anchored in a matrix of aluminum foil are bonded together to form the article. Each laminate is formed by placing sheets of foil on both sides of the boron filament layer and bonding the assembly together in the known manner. Whereas in the past the foil sheets have been of the same alloy or metal, it has been determined that different alloy combinations can be incorporated in a single filament monotape to increase the bondability of tougher alloys without damage to the individual filaments. In other words, a degree of bonding consistent with the aforementioned optimum impact energy absorption may be obtained. An article consisting of commercially available aluminum or aluminum alloys, 1100 Al and 2024 Al sandwiched around the collimated boron filaments has been shown to demonstrate satisfactory impact characteristics. In fact, impact tests have revealed the anisotropic behavior of a blade fabricated from such monotapes or laminates. When impacted from the 2024 Al side, they exhibit impact strengths nearly twice those obtained if impacted from the 1100 Al side, and at least four times that obtainable when compared to an all 2024 Al alloy system.

DESCRIPTION OF THE DRAWINGS

While the specification concludes with claims particularly pointing out and distinctly claiming the subject matter which is regarded as part of the present invention, it is believed that the invention will be more full understood from the following description of the preferred embodiment which is given by way of example with the accompanying drawings, in which:

DESCRIPTION OF THE PREFERRED EMBODIMENT

Figure 1:
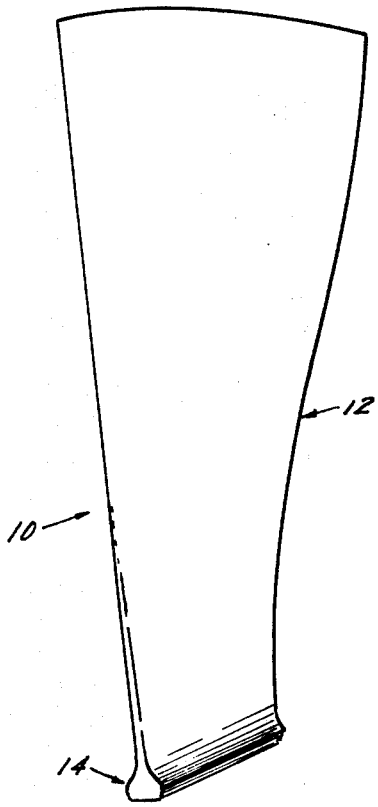
FIG. 1 is a perspective view of a composite gas turbine engine compressor blade embodying the present invention.

Referring to the drawings, attention is first directed to FIG. 1 wherein a composite blade 10 for use in a fluid flow machine and constructed according to the present invention is illustrated. While not so limiting, the blade 10 is adapted for use in axial flow gas turbine engine compressors and fans. It will become apparent to those skilled in the art that the present invention offers an improvement for many bladed structures and that rotor blade 10 is merely meant to be illustrative of one such application. Accordingly, rotor blade 10 is shown to comprise an airfoil portion 12, generally of radially variant camber and stagger, and a dovetail tang 14 which enables the blade to be mounted on and retained by a rotatable disc or hub in a conventional manner. A typical flow path defining platform, not shown, could be mounted between the airfoil 12 and the dovetail 14 portions of the blade.

The major portion, or primary structure, of the blade comprises laminates of elongated filaments having high strength and high modulus of elasticity embedded in a lightweight matrix. The filament laminates are laid and bonded together in essentially parallel relationship to each other to form the airfoil portion 12 of blade 10. In the preferred embodiment involving predominantly metallic material, the blade would comprise bonded boron filament laminates in an aluminum matrix. It is anticipated, however, that the structure could comprise any nonmetallic system, including graphite filaments and an epoxy resin. Further, it is understood that the present invention anticipates the use of any fiber embedded in any binder, such as an organic resin, for its structure.

Figure 2:
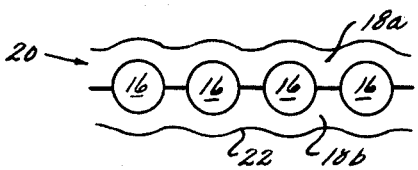
FIG. 2 is a cross-sectional view of a single composite laminate.

Focusing now upon a single filament composite ply or laminate, attention is directed to the cross-sectional view of FIG. 2. Therein, a single layer of collimated, elongated boron filaments 16 is sandwiched between two layers of aluminum foil 18*a,* 18*b* of preferred metals/alloys to be discussed later. These constituents have been diffusion bonded in the known manner to form the unitized ply 20 as depicted. It is to be recognized that while a boron/aluminum composite system is discussed for sake of example, it will become clear that the present invention is not so limiting.

It has been determined that the toughness of a blade or other article under impact, i.e., its tolerance to impact loading, is evoked by activation of at least five impact energy absorption mechanisms. These are (with respect to FIG. 2):

1. deformation of a matrix comprising the aluminum foil 18*a* and 18*b;*
2. filament (16) fracture under tensile loading;
3. matrix/matrix debonding at interface 22 between adjacent plies;
4. filament/matrix debonding (between filaments 16 and matrix material 18*a* and/or 18*b*); and
5. filament (16) pullout from ply 20 under tensile loading.

Analytical representation of this energy-absorbing behavior is as follows:

$$\Sigma I = I_{md} + I_{ff} + I_{mm} + I_{fm} + I_{po}$$

wherein,

I = impact energy absorption
md = matrix deformation
ff = filament fracture
mm = matrix/matrix debonding
fm = filament/matrix debonding, and
po = pullout.

The matrix deformation and filament fracture energies may be considered essentially constant for a given set of materials, although a synergistic behavior may occur. By optimizing the remaining parameters, the total impact energy absorption of the article is maximized. One important facet of this impact absorption is the order in which these energies are released. For example, if filament fragmentation occurs early in the impact cycle, this will limit the energy absorbed due to filament pullout.

Additionally, it has been discovered that as the degree of bonding increases for a given set of materials, the energy absorption potential of the essentially nonconstant energy absorption mechanisms ($I_{mm}$, $I_{fm}$ and $I_{po}$) increases until a critical stage is reached. As the bonding is increased still further, the energy absorption mechanisms decrease until a "brittle" fracture occurs. An example of this overall behavior is shown diagrammatically in FIG. 3 wherein total impact energy absorption of a composite article, bonded as previously described, is plotted as a function of shear strength (a measure of degree of bonding). The curve in FIG. 3 represents the locus of points describing the impact energy absorption versus shear strength for any particular set of materials, and it is recognized that a similar family of curves would represent other filament composite material combinations.

Figure 3:
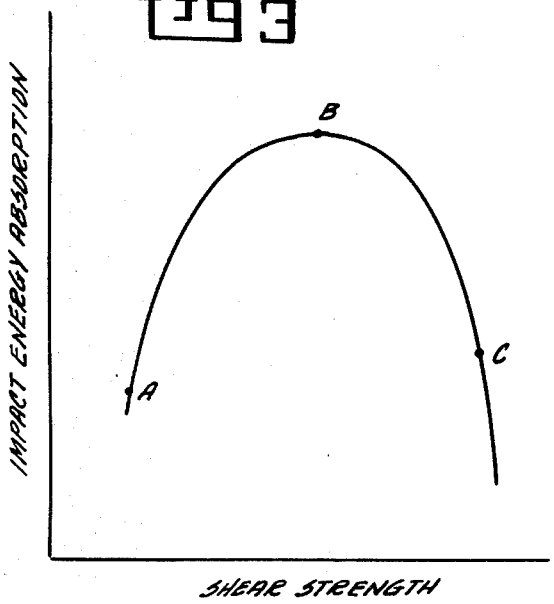
FIG. 3 graphically depicts the impact energy absorption of a composite article as a function of its shear strength.

On the low shear strength side (positive slope) of FIG. 3 (i.e., point A) the filaments and individual laminates are free to move about, much in the manner of a deck of cards, and consequently cannot absorb an extensive amount of energy. As bonding (shear strength) increases, more of the energy absorption mechanisms come into play and the composite article exhibits higher impact strength (point B). Further bonding (actually, overbonding) reduces the absorption mechanisms of delamination ($I_{mm}$ and $I_{fm}$) and filament pullout ($I_{po}$) and causes the filaments to fracture early in the deformation cycle, thereby absorbing only a limited amount of impact energy and behaving as a brittle material (point C).

Figure 4:
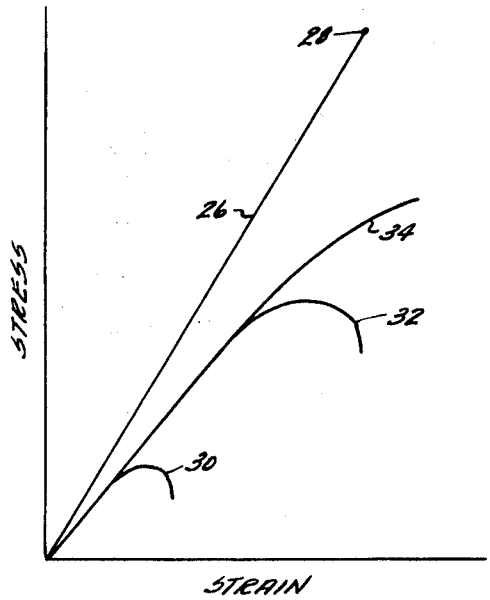
FIG. 4 graphically depicts the shear stress of composite articles as a function of shear strain.

Further illustration of this behavior mechanism appears in FIG. 4 wherein shear stress is plotted as a function of shear strain. Line 26 is indicative of the essentially linear stress-strain relationship for elongated monofilaments 16 (FIG. 2) up to the point of failure (ultimate yield point) 28. Curve 30 depicts a poorly bonded, low shear-strength condition typified by point A, FIG. 3. As stress is applied to such a low bond-strength material, premature delamination precludes the absorption of significant amounts of impact energy. Delamination occurs long before the filament ultimate yield point is reached. In curve 32 of FIG. 4, the matrix is sufficiently bonded such that interlaminate delamination ($I_{mm}$) begins just prior to filament failure and after the initiation of filament/matrix debonding ($I_{fm}$ and $I_{po}$). In this case, representative of point B (FIG. 2), the maximum energy is absorbed since all of the impact energy absorption mechanisms have been brought into play. Thus, this is the strongest article for the given set of materials utilized. Curve 34 illustrates the highly bonded article of point C (FIG. 2) wherein the composite filaments fracture before the onset of delamination ($I_{fm}$ and $I_{po}$) resulting in a brittle composite.

Thus, it clearly becomes advantageous to fabricate an article such as a gas turbine blade with an optimized impact energy absorption potential typified by point B, FIG. 3, and curve 32 of FIG. 4. To that end, the preferred method is to prepare specimens of the bonded filament laminates constructed of the material intended for the article and having varying degrees of shear strength (i.e., varying degrees of bonding). The impact energy absorption/shear strength representation of FIG. 3 can then be obtained through known tests, such as the Charpy impact test. A degree of bonding/shear strength necessary for the desired impact energy absorption can then be selected with confidence for the ultimate article to be fabricated.

In the preferred embodiment of a metallic composite article, particularly a gas turbine engine blade, monotape laminates are laid up and bonded together to form the article. As discussed, each ply or laminate is formed as in FIG. 2 by placing sheets of foil on both sides of the boron layer 16 and bonding them together. In the past, the top and bottom foil sheets (18*a*, 18*b*, respectively) have been of the same metal or alloy. However, it has been discovered that different alloy combinations can be incorporated in a single ply to increase the bondability between the layers and to produce unexpected impact resistance characteristics. For example, 1100 Al (essentially unalloyed aluminum) does not bond to 1100 Al as well as 2024 Al (nominally 4 wt.% copper, balance aluminum alloy) bonds to 2024 Al. 1100 Al, an essentially unalloyed aluminum, exhibits high impact strength and for that reason would appear attractive for gas turbine engine applications. However, the high bonding pressures and temperatures needed to prevent premature delamination may produce a brittle blade (or fracture the collimated filaments). An alloy of the 2024 Al type exhibits good fatigue behavior, but is less desirable due to its tendency to overbond, as well as its lower ductility. While nominally 4 wt.% copper, balance aluminum alloy (2024 Al) has been chosen by way of example, it is recognized that other aluminum alloys can be utilized, such as 1–4 wt.% copper or 2–10 wt.% magnesium.

To enhance the bondability, the 1100 Al material has been bonded with the 2024 Al alloy. This structure, 1100Al/2024Al sandwiched around the collimiated boron filaments, exhibits unexpected anisotropic impact properties in that, when impacted from the 2024 Al side, it exhibited impact strengths nearly twice those obtained when impacted from the 1100 Al side and over four times those obtained in an all-2024 Al blade. (It must be remembered that when a blade is impacted on one side, it is the opposite side which is put into the greater tension.) Metallographic and scanning electron microscopic observations pin-pointed the cause of this behavior to be the ease of debonding of the boron filaments from the 1100 Al. Further, the structure exhibited axial fatigue behavior equivalent to the all-2024 Al composite system. Thus, the degree of bonding of the structure as well as the ductility (plastic behavior) of the matrix materials is determinative of the ultimate impact properties.

Accordingly, a composite blade formed by bonding together a plurality of substantially parallel filament laminates of the type just described would demonstrate the best impact tolerance if the 2024 Al side of each laminate were oriented toward the pressure side of the blade and the 1100 Al side of each laminate were oriented toward the suction side of the blade since it is the pressure side of each blade which is the most susceptible to foreign object impact.

It will be obvious to one skilled in the art that certain changes can be made to the above-described invention without departing from the broad inventive concepts thereof. For example, the concept of multiple alloy plies would be applicable to matrix materials other than aluminum, wherein one side exhibited higher impact strength, and the other side better fatigue/bondability properties. The same approach would also be applicable to resin matrix composites. It is intended that the appended claims cover these and all other variations in the present invention's broader inventive concepts.

Having thus described the invention, what is considered novel and desired to be secured by Letters Patent of the United States is:

1. A composite article comprising a plurality of bonded filament laminates, said laminates including a plurality of collimated filaments sandwiched between and bonded to two metallic foil layers comprising a matrix, wherein the degree of bonding between adjacent laminates is greater than the degree of bonding between the filaments and the matrix, and wherein the ultimate shear stress of the matrix occurs at a strain less than the ultimate shear strain of said filaments.

2. The composite article as recited in claim 1 wherein said filaments comprise boron filaments and said matrix comprises materials selected from the group consisting of aluminum and aluminum alloys.

3. The composite article as recited in claim 1 wherein said laminates comprise a plurality of boron filaments sandwiched and bonded between two layers of foil selected from the group consisting of aluminum and aluminum alloys.

4. The composite article as recited in claim 3 wherein one layer of foil comprises unalloyed aluminum and the other layer comprises an alloy consisting essentially of, by weight, 1 to 5 percent copper with the balance aluminum.

5. The composite article as recited in claim 3 wherein one layer of foil comprises unalloyed aluminum and the other layer comprises an alloy consisting essentially of, by weight, 2 to 10 percent magnesium with the balance aluminum.

6. A blade for use in a fluid flow machine cmprising a plurality of substantially parallel, bonded filament laminates, said laminates including a plurality of collimated filaments sandwiched between and bonded to two metallic foil layers comprising an aluminum-base matrix, wherein the degree of bonding between adjacent laminates is greater than the degree of bonding between the filaments and the matrix, and wherein the ultimate shear stress of the matrix occurs at a strain less than the ultimate shear strain of said filaments.

7. A blade, having a suction surface and a pressure surface for use in a fluid flow machine, comprising a plurality of filament laminates bonded together to form the blade, at least one of said laminates comprising a plurality of collimated filaments sandwiched and bonded between two metallic foil layers comprising a matrix, the first of said foil layers having a higher bondability to itself and said filaments relative to the second of said foil layers under the same bonding process conditions of pressure and temperature, whereby the degree of bonding between said at least one of said laminates and adjacent laminates is greater than the degree of bonding between the filaments and the matrix, and wherein the ultimate shear stress of the matrix occurs at a strain less than the ultimate shear strain of said filaments and said first foil layer is oriented toward the pressure surface of said blade.

8. The blade as recited in claim 7 wherein said filaments comprise essentially boron filaments.

9. The blade as recited in claim 8 wherein said first foil layer comprises unalloyed aluminum and said second foil layer comprises and aluminum alloy.

* * * * *